US007080889B2

(12) United States Patent
Ling et al.

(10) Patent No.: US 7,080,889 B2
(45) Date of Patent: Jul. 25, 2006

(54) ELECTRICAL RECEPTACLE HAVING A SAFETY MECHANISM

(75) Inventors: Renny Tse-Haw Ling, Taipei Hsien (TW); Chun-Sheng Wu, Taipei Hsien (TW)

(73) Assignee: Sinox Co., Ltd., Chung-Ho (TW)

( * ) Notice: Subject to any disclaimer, the term of this patent is extended or adjusted under 35 U.S.C. 154(b) by 0 days.

(21) Appl. No.: 11/161,303

(22) Filed: Jul. 29, 2005

(65) Prior Publication Data

US 2006/0032733 A1 Feb. 16, 2006

(30) Foreign Application Priority Data

Aug. 12, 2004 (TW) ..... 93124254 A

(51) Int. Cl.
*H01H 9/20* (2006.01)

(52) U.S. Cl. ..... 300/334; 200/50.02

(58) Field of Classification Search ..... 200/50.09, 200/51 R, 51.02–51.04, 51.07, 51.12, 50.28, 200/50.29, 50.3, 50.31; 439/259, 954, 181, 439/304, 346, 347

See application file for complete search history.

(56) References Cited

U.S. PATENT DOCUMENTS

| | | | | | |
|---|---|---|---|---|---|
| 3,699,285 | A * | 10/1972 | Leatherman | ..... | 200/51.09 |
| 4,927,373 | A * | 5/1990 | Dickie | ..... | 439/188 |
| 5,061,199 | A * | 10/1991 | McClead | ..... | 439/304 |
| 5,186,639 | A * | 2/1993 | Comerci et al. | ..... | 439/188 |
| 5,299,099 | A * | 3/1994 | Archambault | ..... | 361/837 |
| 5,306,157 | A * | 4/1994 | Francisco | ..... | 439/52 |
| 5,347,095 | A * | 9/1994 | Zeder | ..... | 200/51.09 |
| 5,374,199 | A * | 12/1994 | Chung | ..... | 439/188 |
| 5,434,558 | A * | 7/1995 | Zeder | ..... | 340/568.3 |
| 6,229,107 | B1 * | 5/2001 | Flint et al. | ..... | 200/51.09 |
| 6,750,410 | B1 * | 6/2004 | Lee | ..... | 200/51.03 |

* cited by examiner

*Primary Examiner*—Michael Friedhofer
*Assistant Examiner*—Lisa Klaus
(74) *Attorney, Agent, or Firm*—Winston Hsu

(57) ABSTRACT

The present invention relates to an electrical receptacle having a safety mechanism. The electrical receptacle includes a latch installed internally, where the latch is operated through a switch member positioned externally. The latch can be switched to a locking position or an unlocking position by the switch member. In the locking position, the plug is constrained to be unplugged or the plug is restricted to be inserted. In the unlocking position, the plug is free to be inserted or unplugged.

10 Claims, 15 Drawing Sheets

ELECTRICAL RECEPTACLE HAVING A SAFETY MECHANISM

BACKGROUND OF INVENTION

1. Field of the Invention

The invention relates to an electrical receptacle having a safety mechanism for using in a fixed receptacle, a receptacle with extended line and other assorted receptacles. More particularly, the electrical receptacle is able to constrain a plug when it is inserted or prevent it from being taken off.

2. Description of the Prior Art

An electrical receptacle is connected with a plug of an electrical product for transferring electricity. In FIG. 1, two kinds of prior electrical receptacle 10 and 10' are disclosed. One is fixed on the surface of buildings or objects and the other is a receptacle with an extended line without any surrounding limitation.

FIG. 2 illustrates the major components structure of the electrical receptacle 10. As FIG. 2 shows, the electrical receptacle 10 comprises a substance 12 and a plurality of holes 14 installed on the substance 12 for the pins 162 of an inserted plug 16. A plurality of internal conductivity slices 22 transfer electricity to the electrical products (not shown). The shape and number of the holes 14 correspond with the pins 162 of the plug 16 according to the standard specification of each country. In FIG. 2, the plug 16 comprises two parallel pins 162 which is the specification in the U.S.A., Taiwan and Japan. In other cases, some countries or regions provide different plugs with a third pin and/or different shapes and positions of these pins. FIG. 2 shows a twin pin plug merely as an illustration and not a limitation.

The conductivity slices 22 of the electrical receptacle 10 are made from an elastic and conductive material such as copper. Each of them has an open end 24 towards the outside enabling the pin 162 of the plug 16 to be inserted easily. The elasticity of the conductivity slices 22 can help to clip the pins 162 stably and avoid taking the plug 16 off through force.

There are many shortcomings and safety concerns in the prior art, however. Many electrical products, such as computers and DRAM are not tolerant to electrical interruption. If the plug comes off accidentally, the product will lose its data or damage its substance.

There have been some fixed plug locking apparatus like the electrical product cover of TW 555,272 and the fixed locking apparatus of U.S. Pat. No. 6,652,307. They all provide protection and fixing of plugs in certain situations. They cannot overcome the problem of the plug being fixed unstably, however, or they cannot restrict the electrical receptacle from undesired use.

SUMMARY OF INVENTION

It is therefore a primary objective of the claimed invention to provide an electrical receptacle to solve the above-mentioned problems. The invention is used with fixed plugs to prevent the plug from being taken off during use. Furthermore, the invention can prevent a plug from being inserted.

According to the claimed invention, an electrical receptacle having a safety mechanism comprises a switch member and at least one latch. The latch can be switched to a locking position or an unlocking position through the switch member directly or indirectly. When the latch is in the locking position, it prevents the pins of the plug from being inserted, (if the plug is loose), or the pins being removed, (if the plug is already inserted). Only when the latch changes into the unlocking position can the pins be inserted or taken off freely.

For this reason the major characteristic of the invention is the structure of the electrical receptacle. It can further be used with a safety cover with pins, and a safety cover installed on the electrical receptacle to avoid the holes of the electrical receptacle being used.

In other cases, the safety mechanism can be connected with a lock, further improving its safety.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
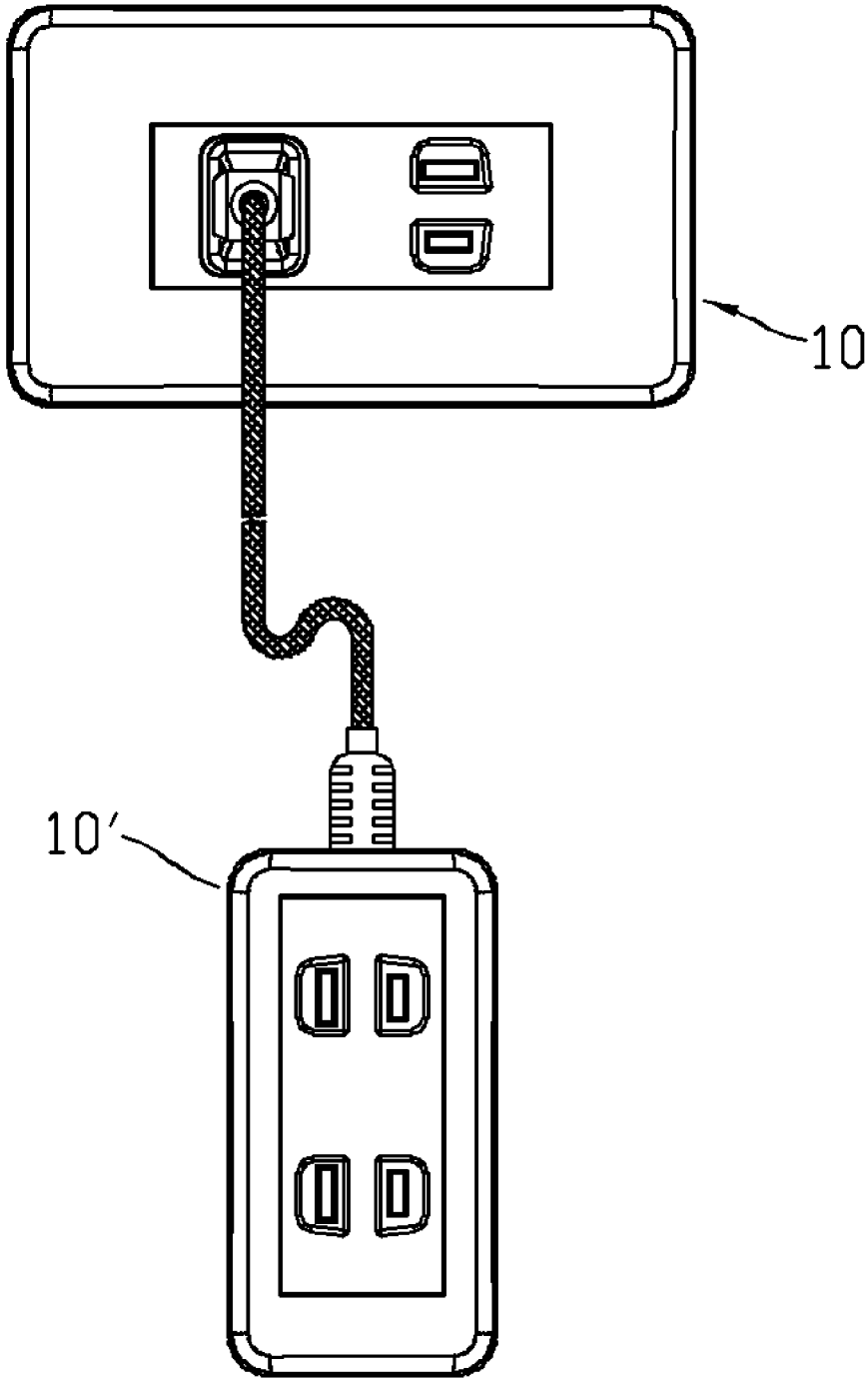
Fig. 1 Prior Art
FIGS. 1 and 2 are the component diagrams of an electrical receptacle according to the prior art.
Figure 2:
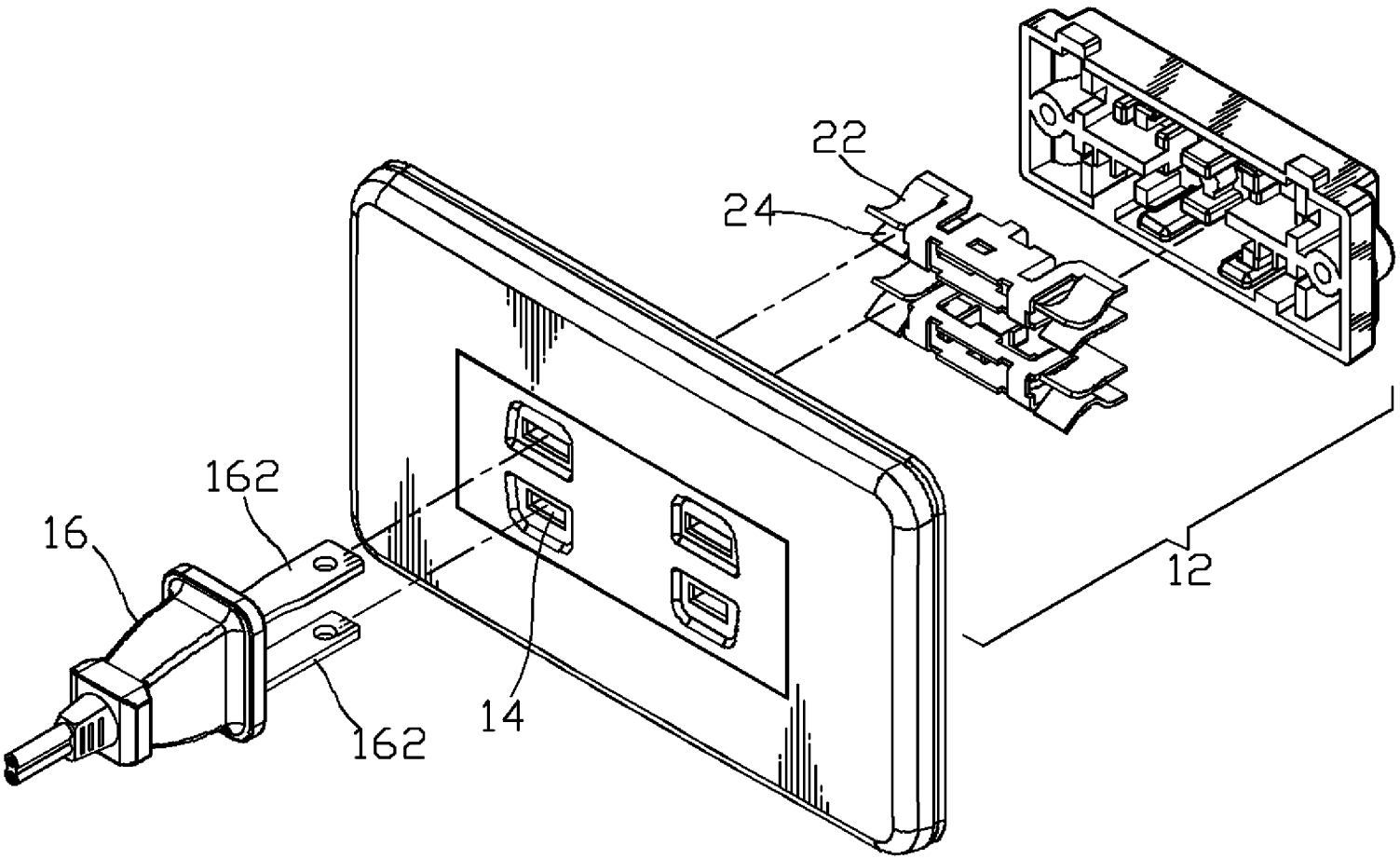
Fig. 2 Prior Art
Figure 3:
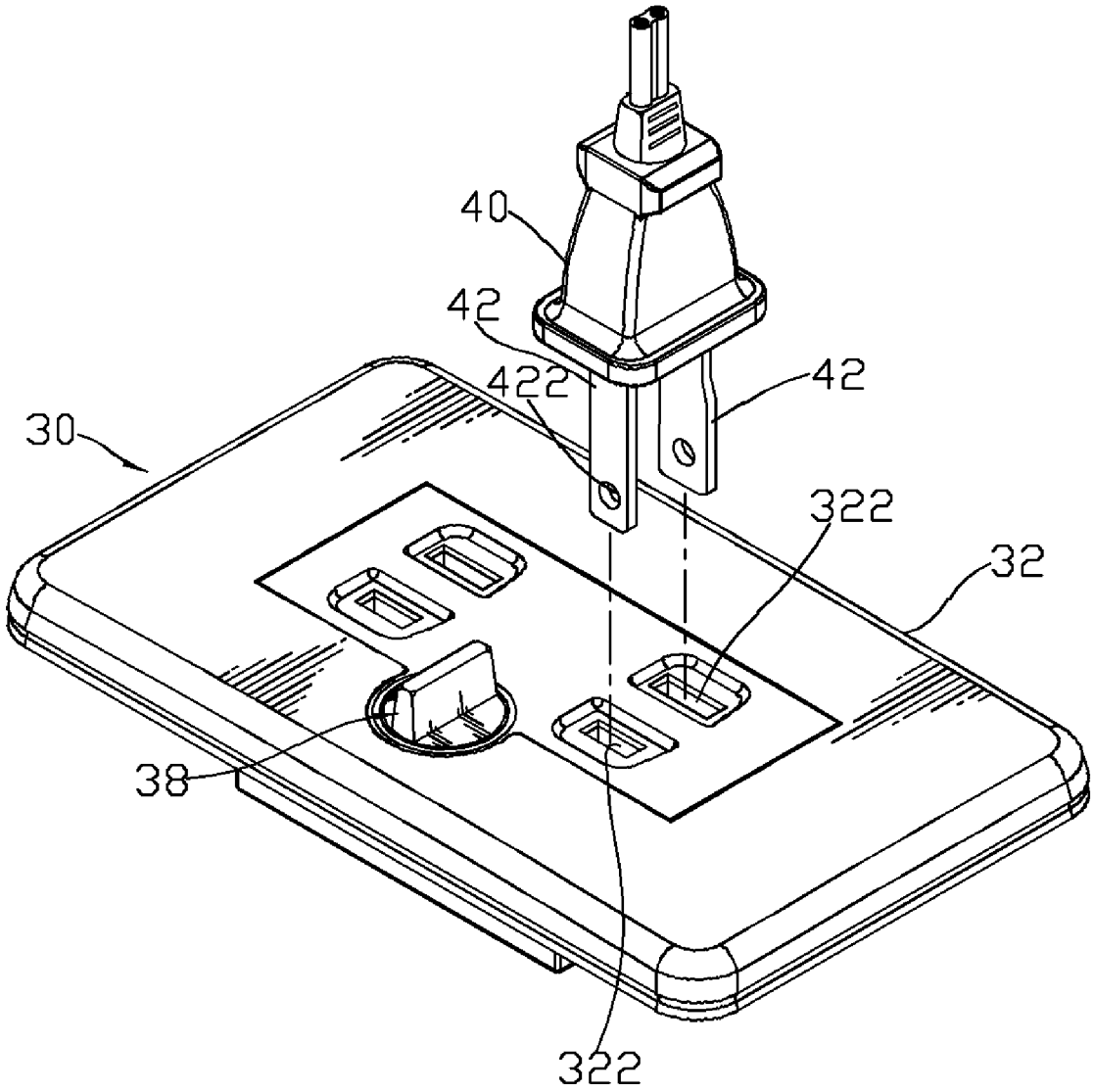
FIG. 3 is the component diagram of an electrical receptacle according to the present invention.
Figure 4:
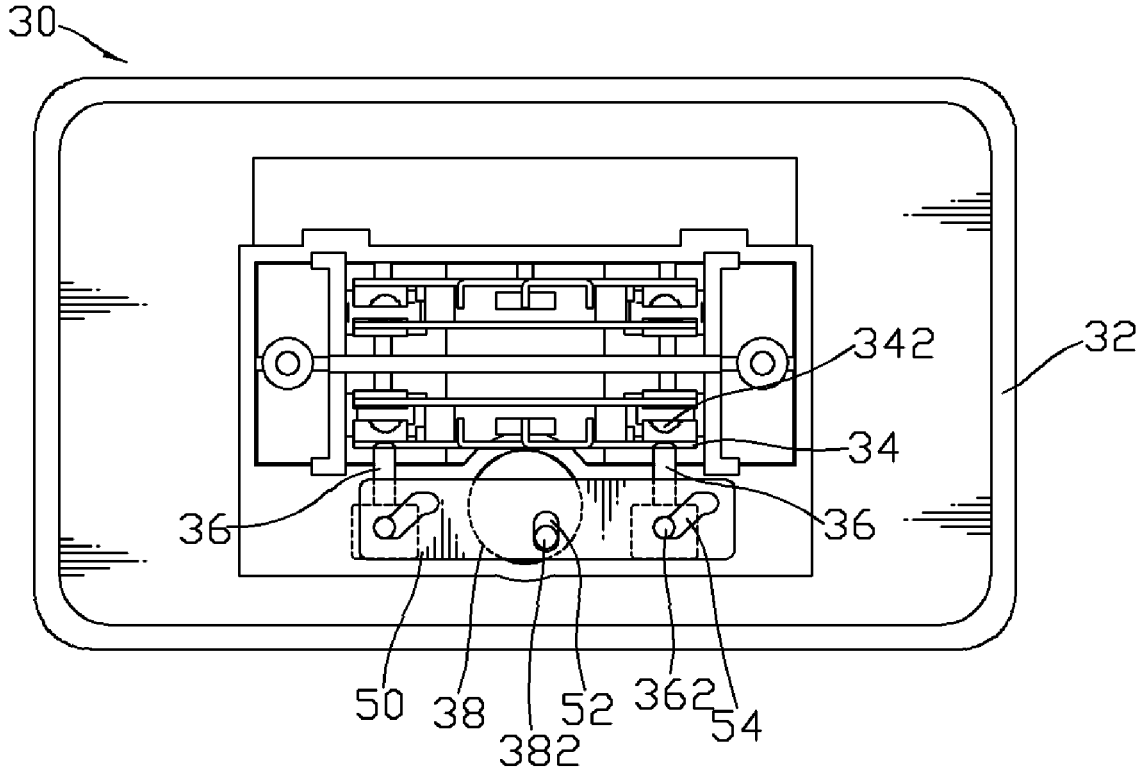
FIG. 4 is the internal structure diagram of the electrical receptacle according to the present invention.

Please refer to FIGS. 3 and 4. They illustrate the components of the electrical receptacles in embodiments of the present invention. The electrical receptacle 30 comprises a substance 32 with a plurality of holes 322, a plurality of conductivity slices 34, a movable latch 36 movably installed in the substance 32, and a switch member 38 installed on the substance 32.

The substance 32 is able to be composed of many kinds of components but essentially comprises the conductivity slices 34 and the latch 36. The shape of the holes 322 installed on the substance 32 varies according to the specification of the plugs 40 in each country or region. The shape of the holes 322 in the present invention corresponds with the plug 40 having two flat pins 42. The number of conductivity slices 34 in the substance 32 is equal to the number of pins 42 of the plug 40. The pins 42 are inserted into the holes 322 for transferring electricity to the electrical product (not shown).

The latch 36 can be moved through the switch member 38. In the diagram, the latch 36 is indirectly moved through the switch member 38 by a linked stick 50. However, the latch 36 could also be connected with the switch member 38 directly and the linked stick 50 is not necessary.

The switch member 38 is connected with the linked stick 50 through a handle 382 and a corresponding trench 52. More specifically, the latch 36 is connected with the linked stick 50 through a short column 362 and an inclined trench 54. For this reason the latch 36 can move synchronously with the switch member 38 through the linked stick 50.

The switch member 38 can also be controlled by force. As the illustration shows, the switch member 38 is a button installed on the substance 32. The switch member 38 is rotated into different angles by force for moving the latch 36.

Figure 5:
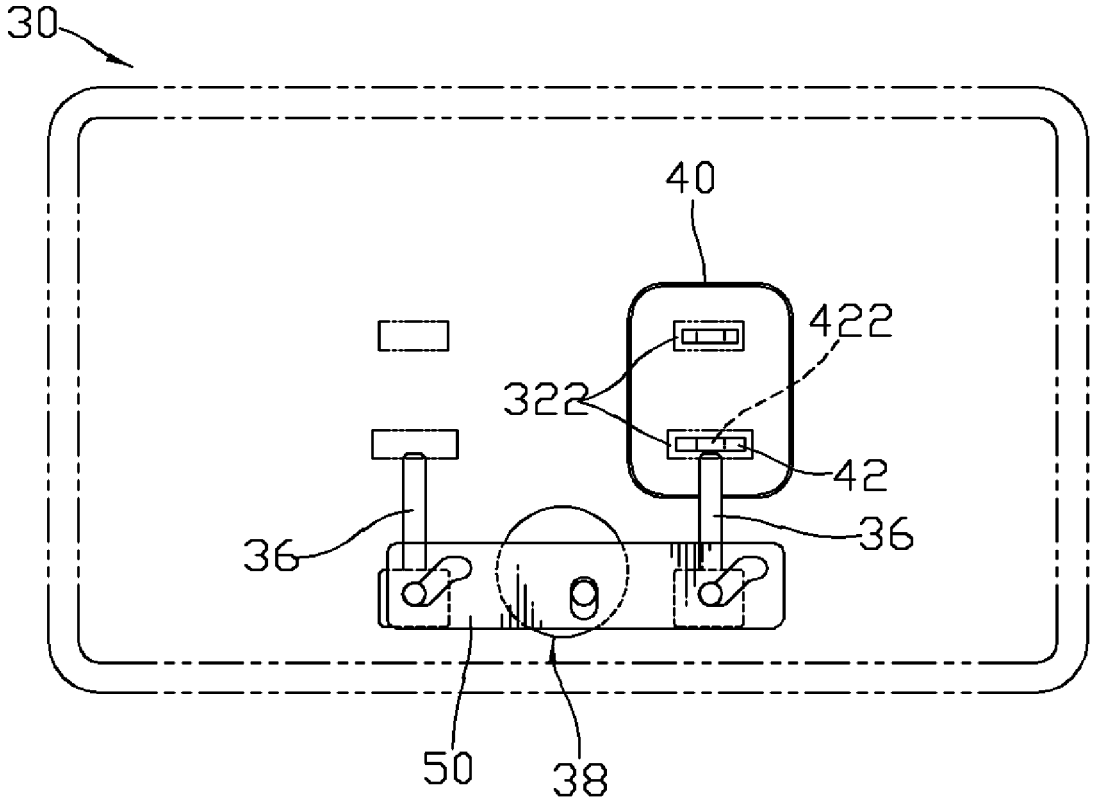
FIGS. 5 and 6 are the movement diagrams showing that the electrical receptacles are controlled by the switch members according to the present invention.
Figure 6:
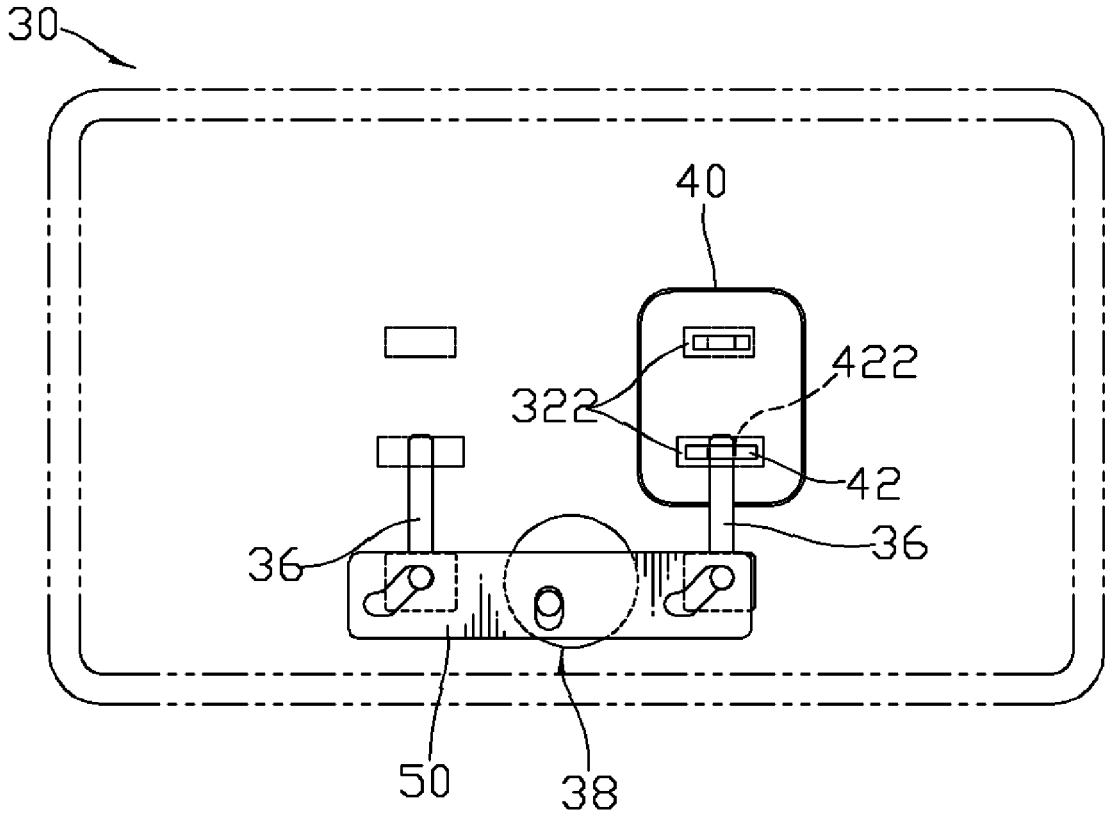

FIGS. 5 and 6 illustrate the electrical receptacle 30 without conductivity slices 34, where the switch member 38 is in different positions. In FIG. 5, the switch member 38 installed on the substance 32 is rotated by force into different positions and the latch 36 is changed to an unlocking position (shown in FIG. 5) or a locking position (shown in FIG. 6) through the linked stick 50. The unlocking position is the condition that the latch 36 is unable to limit the pins 42 of the plug 40 to plug or to unplug. The locking position is the condition that the latch 36 is able to limit the pins 42 of the plug 40 to plug or unplug.

Furthermore, the latch 36 prevents the pins 42 of the plug 40, especially the small holes 422 of the pins 42, from changing into the locking position or the unlocking position, especially the small holes 422 of the pins 42. The pins 42 of the plug 40 are inserted into the holes 322 of the substance 32 firstly and the small holes 422 of the pins 42 are held by the latch 36 for the locking position, and are not held by the latch 36 for the unlocking position.

In the above paragraph, the plug 40 is described as being inserted into the substance 32 already. In reality, the latch 36 could already be in the locking position for limiting the entrance of the pins 42 of the plug 40 through the holes 322. The order of the holes 322 of the substance 32 is shown in the illustration, which shows the linked stick 50 and at least one latch 36 are moved synchronously through an inclined plane or other prior arts according to the corresponding position of the linked stick 50 and the latch 36. The latch 36 and the linked stick 50 could also have different paths.

Figure 7:
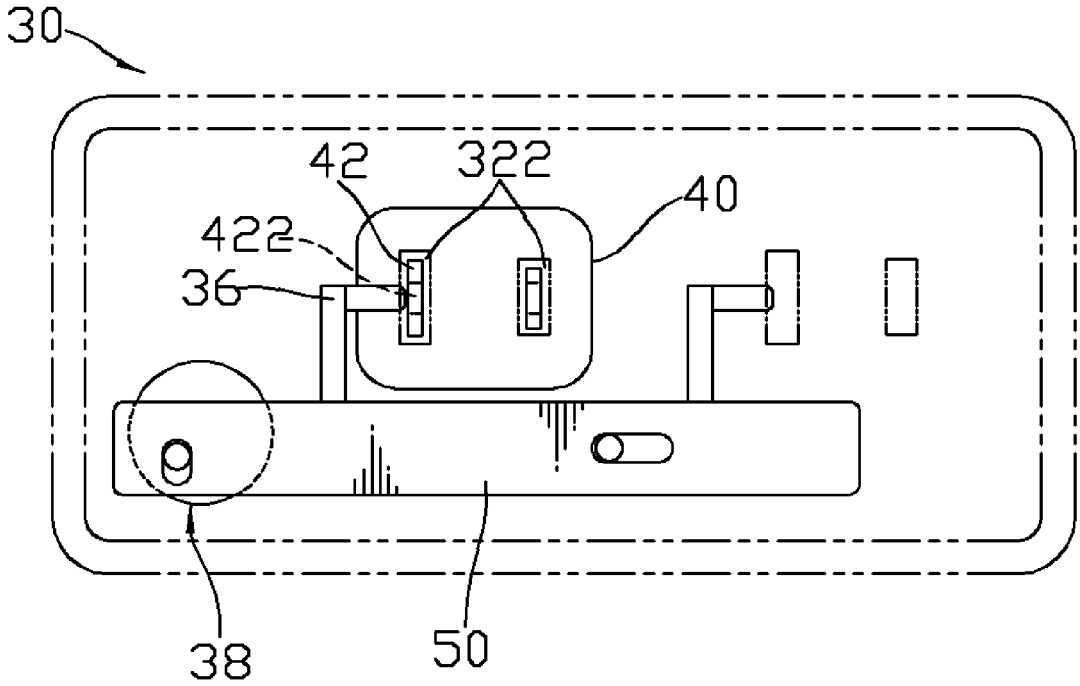
FIGS. 7 and 8 are the movement and structure diagrams according to the present invention.
Figure 8:
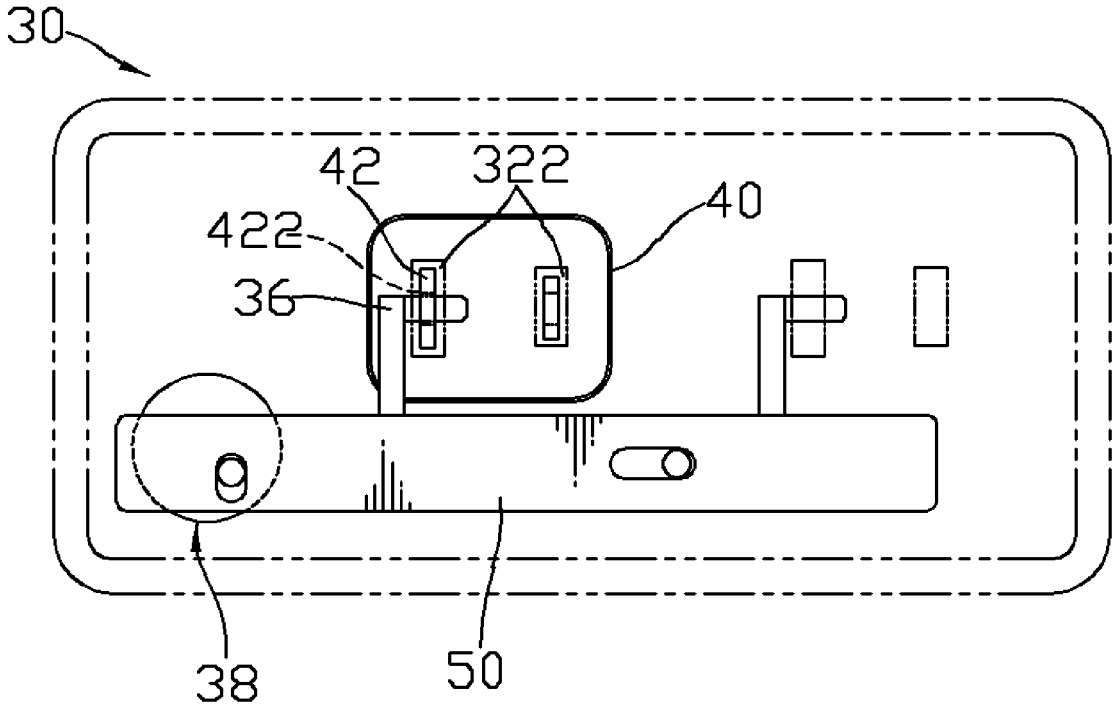

FIGS. 7 and 8 show the other arrangement of the linked stick 50 and the latch 36. As in the illustration, the linked stick 50 and the latch 36 could be a monolithically-formed structure where the path of the pins 42 is limited through the latch 36. Accordingly, the latch 36 is moved synchronously with the linked stick 50, while the linked stick 50 is driven by the switch member 38.

Figure 9:
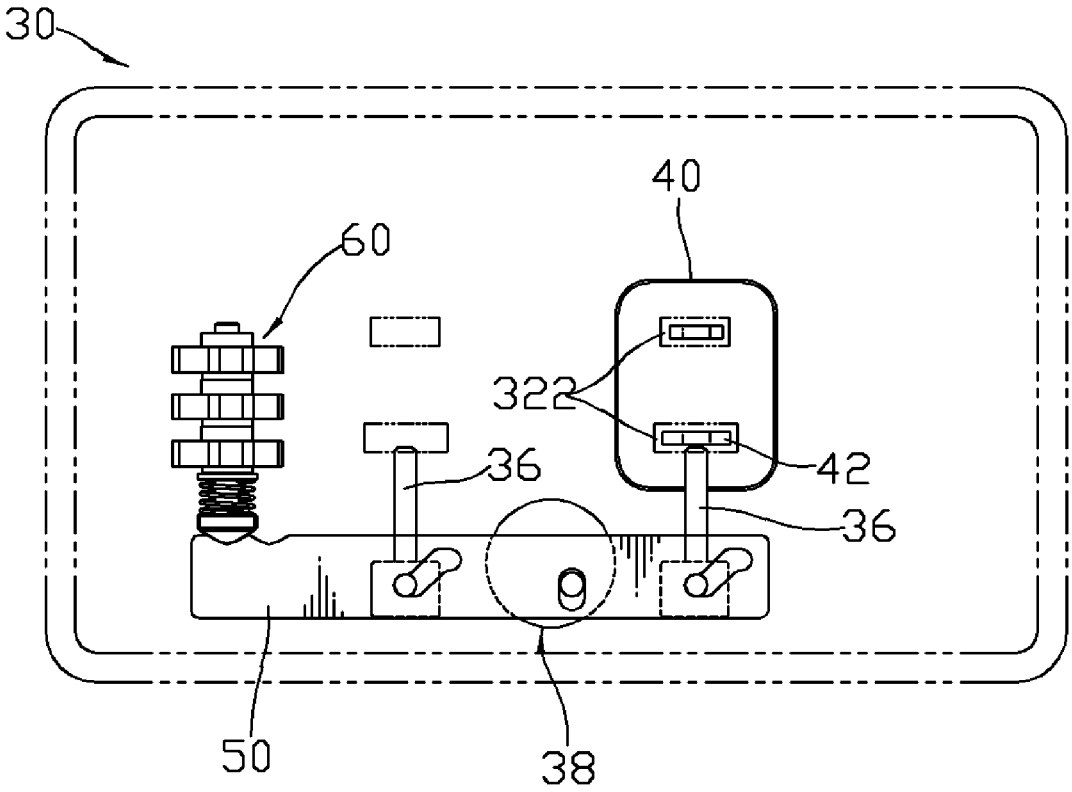
FIGS. 9 and 10 are the movement and structure diagrams according to the present invention.
Figure 10:
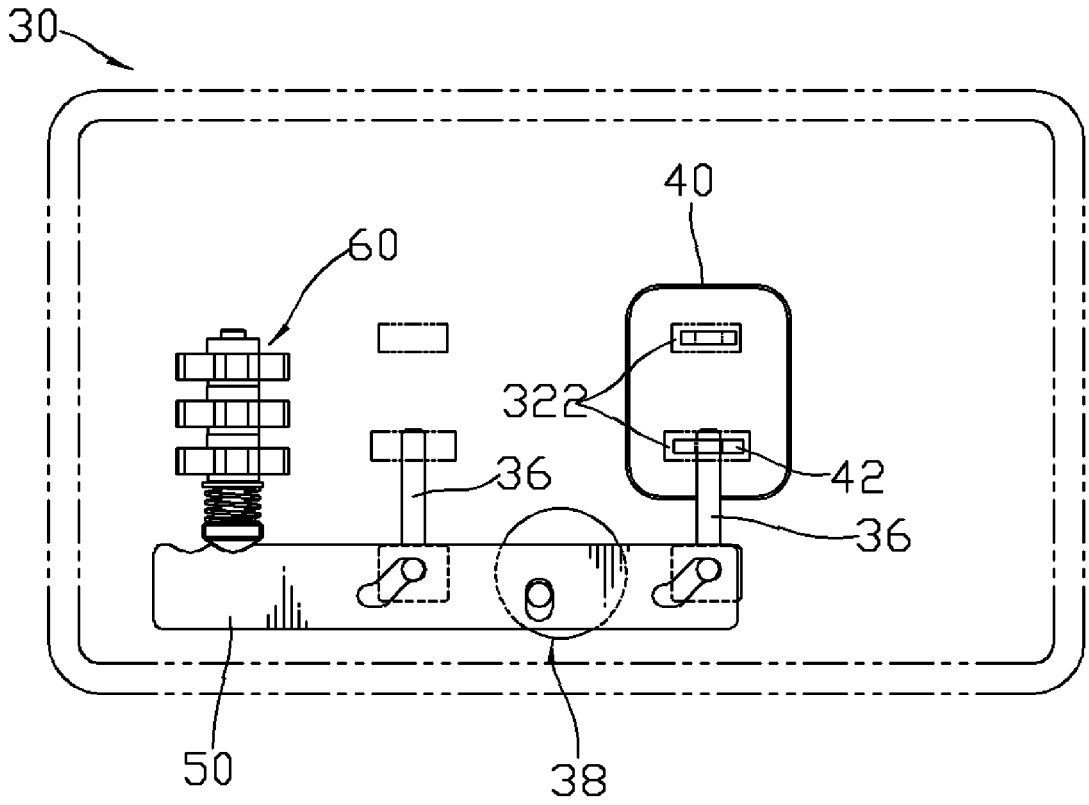

FIGS. 9 and 10 illustrate the electrical receptacle 30 combined with a locking apparatus 60 in the present invention. The electrical receptacle 30 is locked to the linked stick 50 through the locking apparatus 60 meaning the switch member 38 cannot move the latch 36 anymore. The locking apparatus 60 could be any prior combination locks, key locks or button locks. The locking apparatus 60 can be installed in a position for locking the linked stick 50 when the latch 36 is stuck by the linked stick 50 into the locking or unlocking position, and the switch member 38 is unable to be moved by the linked stick 50.

There are many ways that the locking apparatus 60 can lock the switch member 38. The locking apparatus 60 can be combined with the switch member 38 directly; the locking apparatus 60 and the switch member 38 could even be a monolithically-formed structure.

Figure 11:
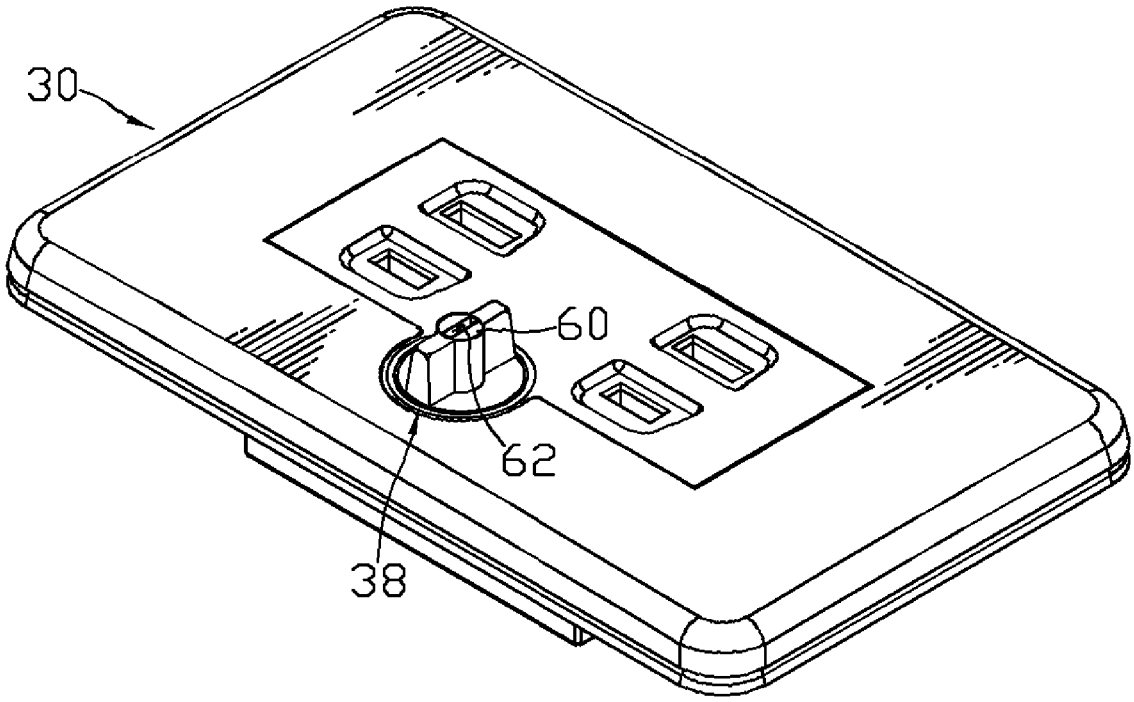
FIG. 11 is a diagram showing that the switch member of the electrical receptacle is connected with the locking apparatus according to the present invention.

FIG. 11 illustrates the electrical receptacle 30 having a substance of the locking apparatus 60 connected with the switch member 38. The locking apparatus 60 in the illustration is a lock that is opened by an identified key. The switch member 38 has a keyhole 62 for the identified key. The key is inserted into the keyhole 62 to release the movement limitation of the switch member 38, allowing the switch member 38 to change the position of the latch 36. Because this locking apparatus is well known to those skilled in the art, the process of locking or unlocking is omitted here.

Figure 12:
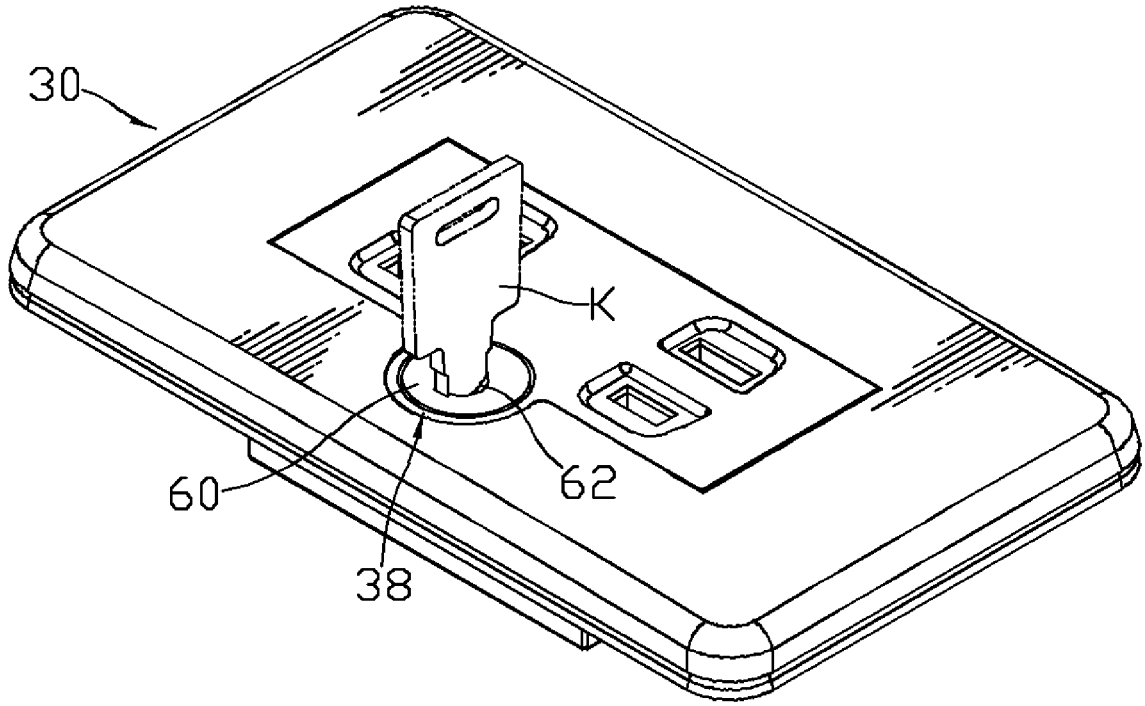
FIG. 12 is a diagram showing that the switch member of the electrical receptacle is connected with the locking apparatus according to the present invention.
Figure 13:
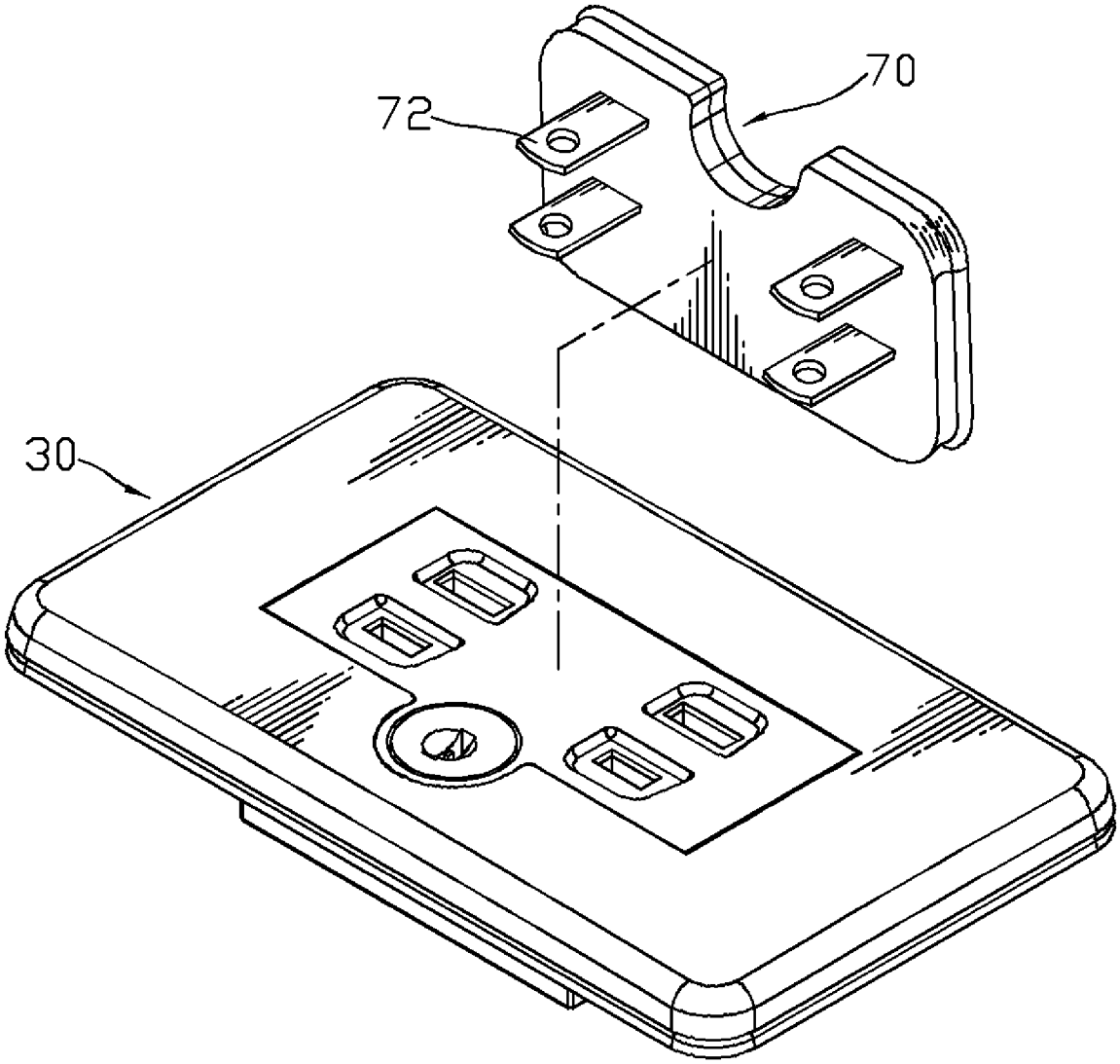
FIG. 13 is a diagram showing that the electrical receptacle has a safety cover according to the present invention.

FIG. 12 shows a switch member 38 connected with an locking apparatus 60 according to the present invention. The key K is inserted into the keyhole 62 and operates the switch member 38 to move the latch 36. And, the switch member 38 is not only a rotating switch in the above invention but also a switching button or any similar member.

From the above descriptions, the present invention is an electrical receptacle 30 having a safety mechanism to limit the pins 42 of plug 40 to be inserted or taken off. This is not limited to the plug 40, however; the electrical receptacle 30 could be inserted by any other plug having a different shape. This is illustrated in FIG. 14, which shows the electrical receptacle 30 covered by a safety cover 70 of pins 72, and the holes 322 concealed to avoid the electrical receptacle 30 being used.

The pins 42 are clipped by the conductivity slice 34 and are stuck by the latch 36 when the pins 42 are inserted into the electrical receptacle 30. As in FIG. 4, because the conductivity slice 34 limits the latch 36 to stick the pin 42, the conductivity slice 34 has an opening 342 for the latch 36.

Figure 14:
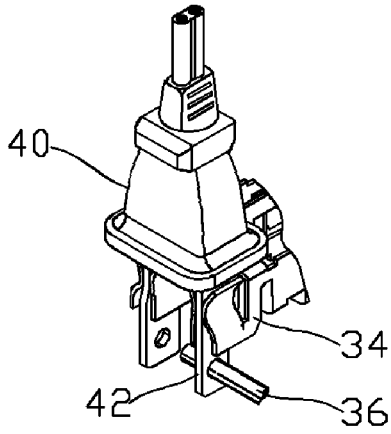
FIGS. 14(*a*), (*b*) and (*c*) are diagrams showing that the electrical receptacles are connected with different pins of plugs according to the present invention.
Figure 14:
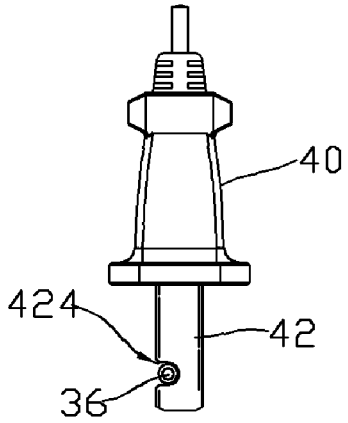
Figure 14:
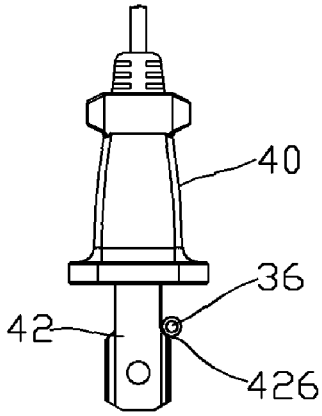

In addition, if the conductivity slice 34 does not limit the latch 36 to stick the pin 42, the conductivity slice 34 need not have any opening as shown in FIG. 14(*a*).

The latch 36 will not only be stopped by the opening 422 of the pin 42 when the latch 36 is stuck with the pin 42 of the plug 40. The gap 424 of the pin 42 in FIG. 14(*b*) and the opposite surface 426 of the pin 42 in FIG. 14(*c*) are also able to stick the latch 36.

Figure 15:
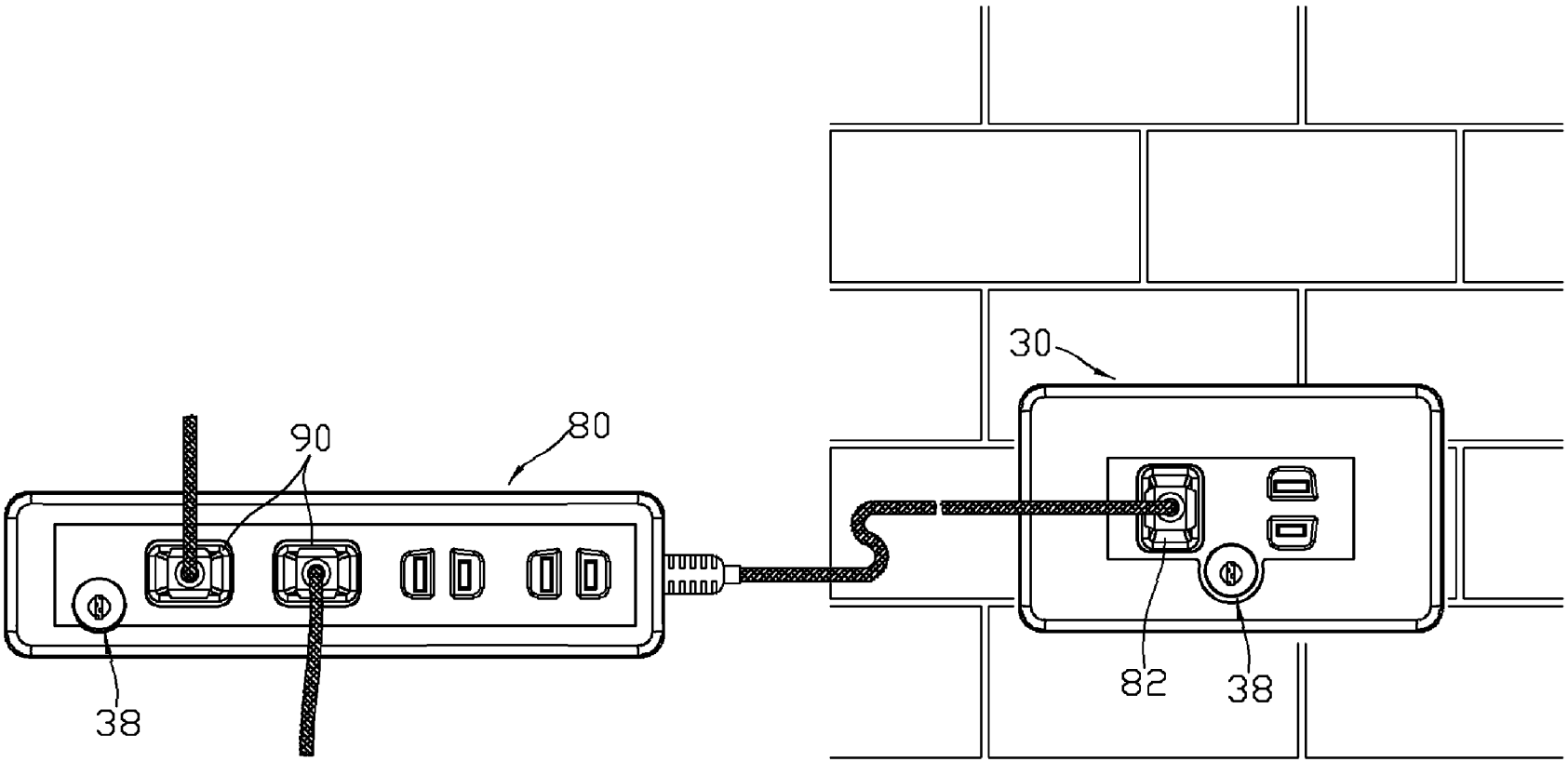
FIG. 15 is an application diagram of the electrical receptacle according to the present invention.

Therefore the present invention is not only suitable for a fixed electrical receptacle 30, but also for a receptacle with an extended line 80 as shown in FIG. 15, or similar products.

As illustrated in FIG. 15, the present invention is used in another kind of product. The fixed electrical receptacle 30 having a safety mechanism limits the receptacle with extended line 80 to be taken off by the plug 82, which is inserted into the receptacle 30. The receptacle with extended line 80 is able to limit the external plug 90 from being taken off or inserted, by its safety mechanism.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical receptacle having a safety mechanism which allows at least an insert with pins to insert into, the electrical receptacle comprising:

a substance comprising at least one set of holes for allowing the pins of the insert to insert into, and a plurality of conductivity slices mounted internally for an electrical connection;

at least a latch movably installed in the substance, the latch being able to be switched to an unlocking position to allow the pins to be taken off from the holes and a locking position to restrict the pins inserted into the holes from being taken off; and a switch member installed in the substance for operating, the switch member being moved with the latch synchronously.

2. The electrical receptacle of claim 1, further comprising a locking apparatus installed in the substance for locking the switch member.

3. The electrical receptacle of claim 2, wherein the locking apparatus and the switch member are a monolithically-formed structure.

4. The electrical receptacle of claim 1, wherein the switch member is moved with the latch synchronously through a linked stick.

5. The electrical receptacle of claim 4, wherein the linked stick comprises a trench, and the switch member comprises a handle embedded in the trench so that the handle and the linked stick are moved synchronously.

6. The electrical receptacle of claim 4, further comprising a locking apparatus installed in the substance for immobilizing the linked stick.

7. The electrical receptacle of claim 4, wherein the linked stick and the latch are in touch with each other, and are moved in different paths.

8. The electrical receptacle of claim 7, wherein the linked stick is moved with the latch synchronously through an incline.

9. The electrical receptacle of claim 8, wherein the linked stick comprises an inclined trench, and the latch comprises a short column embedded in the inclined trench so that the latch and the linked stick are moved synchronously.

10. The electrical receptacle of claim 4, wherein the linked stick and the latch are a monolithically-formed structure, and moved synchronously.

* * * * *